US006733277B2

(12) United States Patent
Huang

(10) Patent No.: US 6,733,277 B2
(45) Date of Patent: May 11, 2004

(54) LIGHTER WITH A LOCK-OFF SWITCH

(75) Inventor: Xinhua Huang, Zhejiang (CN)

(73) Assignee: Ningbo Xinhai Electronics Manufacture Co. Ltd. (CN)

( * ) Notice: Subject to any disclaimer, the term of this patent is extended or adjusted under 35 U.S.C. 154(b) by 0 days.

(21) Appl. No.: 09/861,976

(22) Filed: May 21, 2001

(65) Prior Publication Data

US 2002/0061487 A1 May 23, 2002

(30) Foreign Application Priority Data

Nov. 17, 2000 (CN) ..... 00262389 U

(51) Int. Cl.[7] ..... F23Q 2/28; F23Q 11/36
(52) U.S. Cl. ..... 431/153; 431/132; 431/255
(58) Field of Search ..... 431/153, 255, 431/277, 135, 129, 130, 131, 132; 292/122, 124

(56) References Cited

U.S. PATENT DOCUMENTS

| | | | | | |
|---|---|---|---|---|---|
| 2,465,004 | A | * | 3/1949 | Bolle | |
| 2,493,081 | A | * | 1/1950 | Negbaur | 431/135 |
| 2,701,459 | A | * | 2/1955 | Williams | |
| 2,743,597 | A | * | 5/1956 | Newman | |
| 2,751,772 | A | * | 6/1956 | Salzer | |
| 2,812,202 | A | * | 11/1957 | Lenneis et al. | |
| 3,734,680 | A | * | 5/1973 | Maruyama | |
| 5,142,767 | A | * | 9/1992 | Adams et al. | |
| 5,417,563 | A | | 5/1995 | Cirami | |
| 5,531,591 | A | * | 7/1996 | Yamazaki | |
| 5,558,514 | A | * | 9/1996 | Ansquer | |
| 6,039,561 | A | | 3/2000 | Lei | |
| 6,050,810 | A | | 4/2000 | Huang | |
| 6,077,070 | A | | 6/2000 | Doucet et al. | |
| 6,135,761 | A | * | 10/2000 | Chen | |
| 6,186,772 | B1 | * | 2/2001 | Huang | |
| 6,206,689 | B1 | * | 3/2001 | Doucet et al. | |
| 6,386,860 | B1 | * | 5/2002 | Adams et al. | 431/153 |
| 6,431,853 | B1 | * | 8/2002 | Sher | 431/153 |
| 6,443,727 | B1 | * | 9/2002 | Huang | 431/132 |
| 2002/0115031 | A1 | * | 8/2002 | Chen | 431/153 |

FOREIGN PATENT DOCUMENTS

| | | | | |
|---|---|---|---|---|
| EP | 0482411 | | 4/1992 | |
| JP | 405157235 | * | 6/1993 | 431/153 |

OTHER PUBLICATIONS

European Search Report dated Feb. 7, 2002.

* cited by examiner

*Primary Examiner*—Carl D. Price
(74) *Attorney, Agent, or Firm*—Ostrolenk, Faber, Gerb & Soffen, LLP

(57) ABSTRACT

A locking lever for a lighter actuation mechanism prevents the actuator from operating when in a locked position. Operation of the lever causes a portion of the lever to be withdrawn from a housing portion of the lighter and permit the actuator to be moved and operated. The lever mechanism is spring loaded so that the end of the lever normally extends into the lighter housing in a locked position. A top portion of the lever is flattened and curved to prevent intuitive operation by a child, while permitting an adult to easily disengage the locking mechanism. An end portion of the locking lever has a sloped profile to move the lever in an upward direction when the actuator device is returned to a normal position after operating the lighter. When the lighter actuator returns to a normal position, the spring loaded lever again extends into the housing of the lighter to prevent accidental operation. The locking lever is accessible through a top surface of the lighter actuator to permit the lighter to be unlocked and actuated with a simple motion that is convenient for adults, but difficult for children.

16 Claims, 2 Drawing Sheets

LIGHTER WITH A LOCK-OFF SWITCH

FIELD OF THE INVENTION

The present invention relates to a lighter, and more particularly to a lighter with a lock-off switch.

DESCRIPTION OF THE PRIOR ART

A lighter commonly used at present has an electric igniter and uses a combustible gas, such as butane gas or natural gas, as a fuel. The igniter is of a type that has been widely used in many cases where ignition is required, and may be comprised of a piezoelectric device with a piezoelectric block and actuator. The lighter can create a flame usually be pressing the operative actuator directly and permitting the piezoelectric block in the piezoelectric device to spark and ignite the combustible gas. If the lighter is not provided with a lock-off switch (or a safety device), the operation of the actuator is not restricted, and an unintentional operation of the actuator can occur. For example, the lighter can be accidentally ignited, ignited through operation by an infant, or through an unintentional collision with a hard thing acting on the actuator. When the lighter is ignited through any of these operations, a dangerous condition can occur that can hurt the infant or become a public safety hazard. In addition, if an external unintentionally acts on the actuator, even if the piezoelectric block is not actuated, the outlet valve can be opened. The combustible gas can potentially leak from the opened valve so that there is a potential risk of explosion due to the leaking of the combustible gas. Therefore, some countries and territories have prohibited or will prohibit the production and sale of lighters that lack a lock-off switch.

SUMMARY OF THE INVENTION

An object of the present invention is to overcome the drawbacks of the prior art mentioned above. It is a further object of the present invention to provide a lighter with a lock-off switch that prevents the actuator of the lighter from being directly operated, and thus avoid the above-mentioned potential hazard. The lighter of the present invention provides not only a greater ignition efficiency, but also greater safety.

In order to achieve the above object, according to the present invention, there is provided a lighter which comprises a tank in a housing, a piezoelectric device in the housing, an outlet device, and a windshield above the tank. The piezoelectric device comprises a piezoelectric block and an actuator. The outlet device comprises an outlet valve and a lever, which are assembled together in a conventional manner. The lighter includes an actuator that is provided with a lock-off device of a lever mechanism coupled therewith. The lock-off switch comprises a button and a return spring. The upper end of the button is disposed on the top surface of the actuator, with a lower end placed in the housing in a locking state. The return spring is located between the actuator and the button. Since is the button is disposed on the actuator, the lower end of the button abuts against the inner wall of the housing in the locked state to prevent the actuator from being operated. The lower end of the button abuts the housing to lock and make it difficult to turn the actuator. The button is pushed in a counterclockwise direction to cause the lower end thereof to disengage from the housing wall. The actuator is subsequently turned in the clockwise direction, and the piezoelectric block can spark and ignite the combustible gas so as to create a flame. After the actuator is released, the return spring causes the button to be restored to a lock position, while the actuator returns to a home position as well.

According to one aspect of the present invention, the lighter with a lock-off switch has a button that is substantially umbrella shaped. The umbrella-shaped button is pivotally arranged in a chamber in the actuator. The pivotal arrangement can be achieved by a rotation shaft on the button, or by fitting two projections on opposed sides of the button center. The shaft or projections fitted into recesses in the actuator or other equivalent arrangements, that permit flexible operation of the button. The button thus forms a lever that can achieve a locked status through the lever system in conjunction with the housing. One end of the button is adapted to be operated by a user, and the other end thereof is adapted to lock the lighter in position to prevent the actuator from being operated. Further, operation of the button is simple to accomplish according to its design, and has a configuration that is aesthetically appealing.

According to another aspect of the lighter with a lock-off switch of the present invention, the return spring vertically surrounds the positioning pin of the actuator. This configuration is reliable. After completing the ignition operation, the button can return to its initial position automatically and can be restored to the locked state under the force of the spring.

According to another aspect of the present invention, a lower cover is provided at the bottom of the housing to ensure a reliable and efficient seal for the tank.

According to the invention, the actuator has been provided with a lock-off switch cooperating with it. If the button for the lock-off switch is not pressed, the actuator does not operate. This configuration overcomes the above problems of the prior art, improves the safety of the lighter and prevents unintentional operation of the lighter.

The present invention will be described in detail by way of example and with reference to the accompanying drawings.

DESCRIPTION OF THE PREFERRED EMBODIMENT

Figure 1:
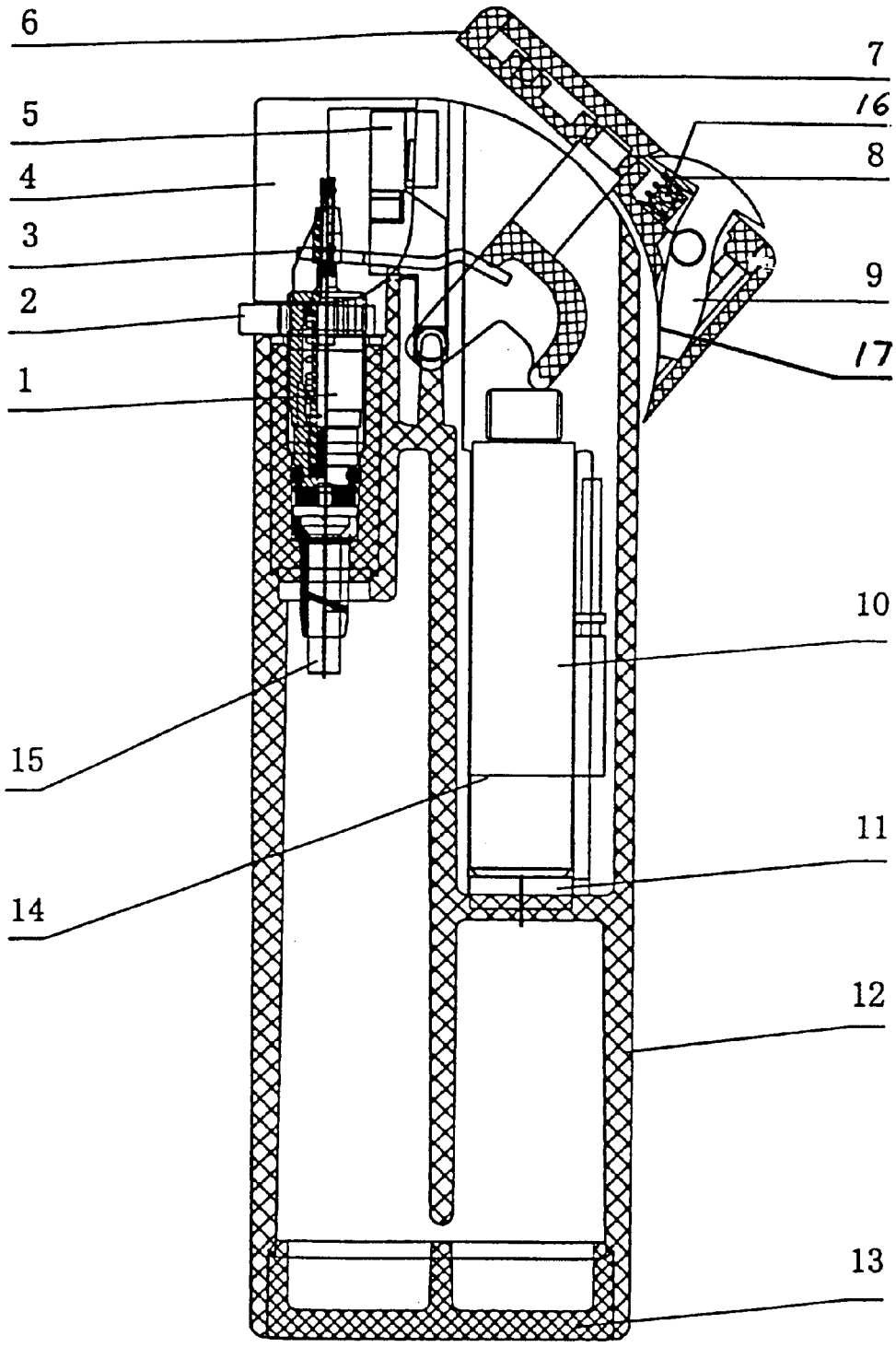
FIG. 1 is a schematic view showing the general configuration of the lighter according to the present invention.

As shown in FIG. 1, the lighter of the present invention comprises a housing with a tank 12, a piezoelectric device 14 in the housing, an outlet device 15 and a windshield 4 thereabove. An inner shield 5 is located in the windshield 4. The outlet device 15 comprises an outlet valve 1 and an lever 3. The piezoelectric device 14 comprises a piezoelectric block 10 and an actuator 6. A top cover 7 is provided at the upper portion of the actuator 6, with all of the above components assembled together in a conventional manner.

When the actuator 6 is pressed down, the lever 3 opens the outlet valve 1, and the piezoelectric block 10 locates a spark to ignite the gas. A regulator ring 2 for adjusting the flame is provided on the outlet device 15. The windshield 4 is adapted to shield the flame from wind and the inner shield 5 is adapted to isolate the flame. The actuator 6 is provided with a step therein, on which a positioning pin 16 is provided. The button 9 is shaped substantially like an umbrella, with an upper end that is semi-spherical in shape.

The button 9 is positioned on the surface of the actuator 6, and with a lower end placed in the housing in the locked position, and disengaged from the housing in the unlocked position. A return spring 8 is located between the actuator 6 and the button 9 and vertically surrounds the positioning pin 16. With this arrangement, the button 9 can be restored to its initial position automatically. In addition, the left side of the actuator 6 contacting the button 9 is substantially of a circle arc shape, which can facilitate depression of the button 9. The button 9 can be supported on the actuator 6 pivotally with a rotation axis, about which the button 9 can pivot.

Figure 2:
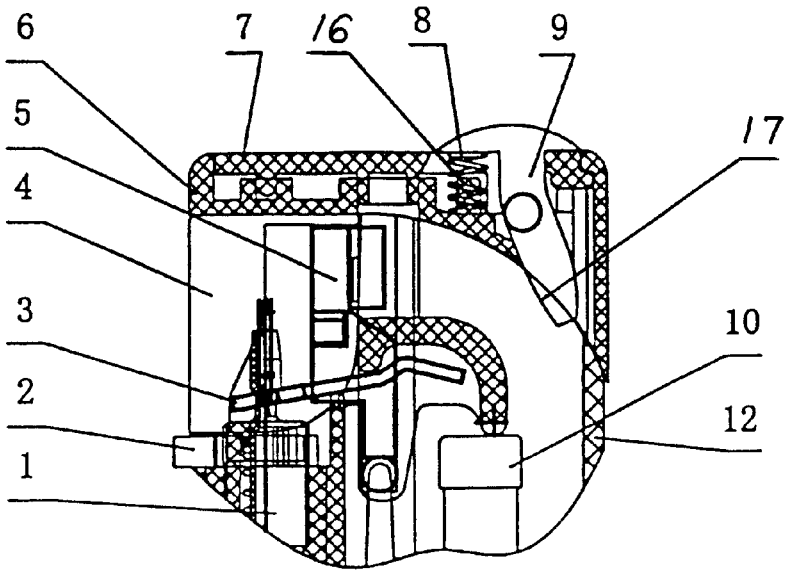
FIG. 2 is a schematic view showing the lighter in its locking position according to the invention.

As shown in FIG. 2, in the locked position, the lower end of the button 9 is blocked by the inner wall of the tank 12. In this position, the actuator 6 cannot be rotated directly by a user's finger. The prevention of the operation of the actuator produces a locking effect and avoids the dangers of accidental operation or operation by an infant at play.

Figure 3:
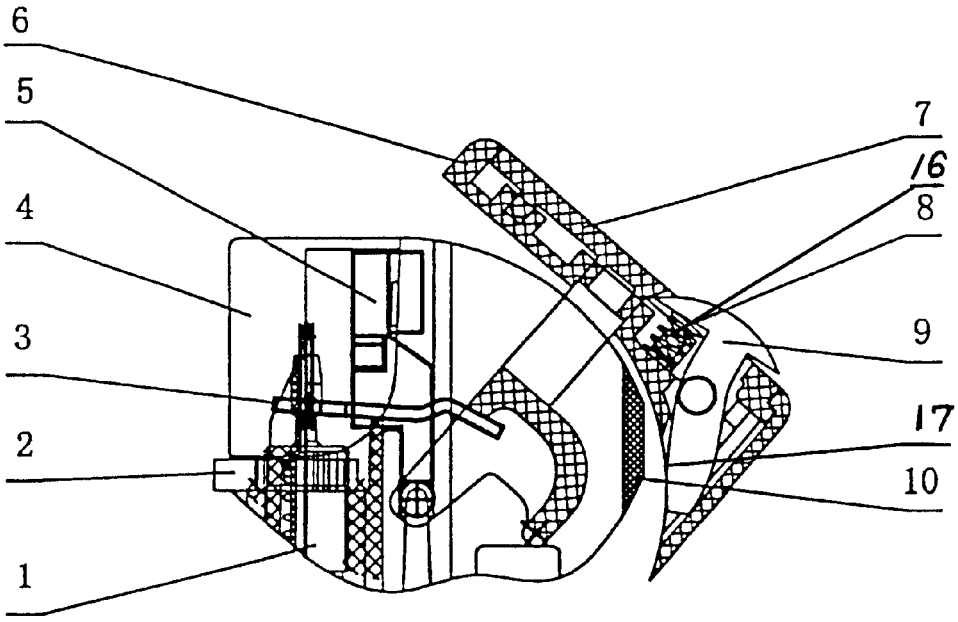
FIG. 3 is a schematic view showing the lighter in its operating position according to the invention.

As shown in FIG. 3, the button 9 is operated according to the locking lever system. A force applied on the upper end of the button 9 by a user's finger causes the lower end of the button 9 to disengage from the housing. Once the lower end of button 9 disengages the housing, the actuator 6 can be turned, so that the lighter can generate a flame. When released, the actuator 6 returns to a home position and the button 9 is restored to its locking position under the return force of the return spring.

The present invention includes, but not exclusively, the embodiment described above. Various modification and variations limiting the operation of the actuator by means of a control member with a lever system will fall within the protective scope of the present invention. For example, the control member may be a straight bar, a curved bar or an equivalent component of other shape, and its material may be plastic or metal. Accordingly, the invention is not to be limited by the embodiments of the disclosure, but by the claims appended herewith.

What is claimed is:

1. A lighter with a safety mechanism, comprising:

a housing with a fuel chamber therein, said housing having a top portion and a bottom portion;

an outlet valve in said top portion and connected to said fuel chamber;

a valve lever coupled to said outlet valve and operable to open and close said outlet valve;

a piezoelectric block in said housing and operable to generate electric charge;

an actuator having a top surface opposed to said bottom portion when said actuator is not actuated, said actuator being pivotally coupled to said top portion and operable on said piezoelectric block and said valve lever to open said outlet valve while generating an electric charge from said piezoelectric block with sufficient voltage to cause a spark and ignite a vaporized fuel releasable from said fuel chamber through said outlet valve when said actuator pivots;

a blocking lever with a first end extending through an opening in said top surface and a second end extending into said top portion of said housing and cooperating with said housing to prevent actuation of said actuator in a first position;

a resilient member urging said lever into said first position to provide a normally blocked position; and said lever being moveable against said urging of said resilient member to a second position, whereby said second end of said lever is clear of said housing thereby permitting said actuator to operate.

2. A lighter according to claim 1, wherein said second end of said lever extending into said housing has a sloped profile that can cooperate with an edge of said housing to urge said lever upward when said actuator is returned to a home position.

3. A lighter according to claim 1, wherein said lever is pivotable about a point in said actuator.

4. A lighter according to claim 3, wherein said actuator pivots about a point located in said housing.

5. A lighter according to claim 4, wherein said actuator and said blocking lever actuate in relatively opposite rotational directions.

6. A lighter according to claim 1, wherein said resilient member is a spring.

7. A lighter according to claim 6, wherein said spring is located in a chamber in said actuator.

8. A lighter according to claim 7, further comprising:

a positioning pin in said chamber; and a portion of said spring surrounds said positioning pin.

9. A lighter according to claim 1, further comprising a cover on a bottom portion of said housing.

10. A lighter according to claim 1, further comprising a curved surface on said first end, elongated in a direction substantially orthogonal to a longitudinal axis of said lever.

11. A lighter according to claim 10, wherein said blocking lever has an outwardly convex shape on an upper surface with an elongated leg depending from a region including said upper surface.

12. A safety mechanism for a lighter with a gas valve at an upper portion of a body portion of said lighter capable of releasing a gas that can be ignited by a spark from a piezoelectric element in said body portion of said lighter, said safety mechanism, comprising:

an actuator pivotally coupled to said upper portion and having a top surface over said body portion when said actuator is not actuated, said top surface having an opening therein;

a lever pivotally coupled to said actuator with a first end extending through said opening and a second end extending below said actuator and into said body portion of said lighter and cooperating with said body portion to block actuation of the actuator when in a first position;

a pin in said actuator and positioned to extend in a direction tangential to a level pivot direction;

a resilient member on said pin and extending to said lever for urging said lever into said first position thereby preventing actuation of said actuator; and said lever being moveable against said urging of said resilient member to a second position, whereby said second end of said lever is clear of said body portion thereby permitting said actuator to actuate.

13. A safety mechanism according to claim 12, wherein said lever is pivotally operable in a direction relatively opposite to an actuation pivot direction of said actuator.

14. A safety mechanism according to claim 12, wherein said second end of said lever extending into said body portion has a sloped profile that can cooperate with an edge of said body portion to urge said lever upward when said actuator is returned to a home position.

15. A safety mechanism according to claim 12, further comprising an outwardly convex curved surface on said first end, elongated in a direction substantially orthogonal to a longitudinal axis of said lever.

16. A safety mechanism according to claim 15, wherein said lever further comprises an elongated leg depending from said curved surface on said first end and extending along said longitudinal axis and through a pivot point of said lever.

* * * * *